US005154497A

United States Patent [19]

Smith

[11] Patent Number: 5,154,497

[45] Date of Patent: Oct. 13, 1992

[54] SECURITY LOCKING SYSTEM FOR MULTIPLE DRAWER UTILITY CABINETS WITH INDIVIDUALLY SEALED DRAWERS

[76] Inventor: Jane H. Smith, 8009 Calabria Ct., Orlando, Fla. 32819

[21] Appl. No.: 529,621

[22] Filed: Dec. 31, 1990

[51] Int. Cl.[5] ..... E05B 65/44

[52] U.S. Cl. ..... 312/215; 70/78; 70/85; 70/212; 292/DIG. 68

[58] Field of Search ..... 312/215, 333, 330.1; 70/85, 439, 440, 78, 79, 86, 203, 212; 292/286, DIG. 68

[56] References Cited

U.S. PATENT DOCUMENTS

| | | | |
|---|---|---|---|
| 1,025,284 | 5/1912 | Lybeck | 70/85 |
| 1,496,099 | 6/1924 | O'Connor | 70/86 |
| 2,114,098 | 4/1938 | Baerfuss | 292/286 X |
| 3,034,819 | 5/1962 | Tupper | 70/440 X |
| 3,357,762 | 12/1967 | Forsyth | 312/215 |
| 3,834,746 | 9/1974 | Hinden | 70/85 X |
| 3,856,373 | 12/1974 | Tucich | 70/85 X |
| 4,030,788 | 6/1977 | Bleecker | 70/85 X |
| 4,118,057 | 10/1978 | Ryan | 70/440 X |
| 4,595,246 | 6/1986 | Bross | 312/348.3 |
| 4,906,059 | 3/1990 | Reiner et al. | 312/215 X |

*Primary Examiner*—Kenneth J. Dorner
*Assistant Examiner*—Brian K. Green
*Attorney, Agent, or Firm*—Oliff & Berridge

[57] ABSTRACT

A method and apparatus for securing items in a storage unit comprise providing a cabinet with a plurality of drawers. Each drawer can be individually sealed by a break lock pull-tight security seal. As a security seal for a particular drawer is twisted and broken, items can then be obtained from the drawer. If a seal has been broken, a visual indication is made that the drawer has either been opened or tampered with. The inventory can thus be quickly and easily checked on a recurring basis without requiring each individual drawer to be checked since only drawers with broken seals need to be checked. The cabinets can be used to store pharmaceuticals, medical supplies, industrial supplies and/or any other supply for which an inventory must be maintained.

3 Claims, 2 Drawing Sheets

SECURITY LOCKING SYSTEM FOR MULTIPLE DRAWER UTILITY CABINETS WITH INDIVIDUALLY SEALED DRAWERS

BACKGROUND OF THE INVENTION

1. Field of the Invention

The present invention relates to multiple drawer utility cabinets and, more particularly, to multiple drawer utility cabinets having individually sealed drawers.

2. Description of Related Art

Multiple drawer utility cabinets are commonly used to store necessary supplies in, for example, pharmacies, ambulances, hospital nursing units, physicians' offices, utility trucks, other service vehicles, manufacturing plants, industries, etc. In such applications, it is often necessary to determine whether contents of any of the drawers have been used and, accordingly, whether any drawer needs to be restocked.

Heretofore, multiple drawer utility cabinets have contained individually locked drawers to enable access to the drawer contents only by persons having keys and/or combinations required to unlock the drawers. In order to check whether contents of the drawers have been used, it has generally been required to unlock each drawer, count the contents therein, and replace drawer items which have been used. This process can be very time consuming, particularly when a large number of items are provided in the drawers or when a large number of drawers are used.

OBJECTS AND SUMMARY OF THE INVENTION

An object of the present invention is to provide a multiple drawer utility cabinet which secures inventory items within its drawers.

Another object of the present invention is to provide a multiple drawer utility cabinet which visually indicates that drawer items have been removed.

A further object of the present invention is to provide a multiple drawer utility cabinet which prevents pilferage of drawer items.

To achieve the foregoing and other objects and to overcome the shortcomings discussed above, a method and apparatus for storing inventoried items are provided. A storage unit comprises a cabinet having a plurality of drawers provided therein. Each drawer is individually sealed by a break lock pull-tight security seal. As the security seal is twisted and broken, items can then be obtained from a locked drawer. The twisting and breaking of the security seal provides a visual indication that the drawer has been opened or tampered with. Accordingly, an individual taking inventory of the contents of the cabinet is readily informed that a particular drawer may need to be restocked. Further, the individual need not waste time taking inventory of drawers which have not been opened or tampered with.

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENT

Figure 1:
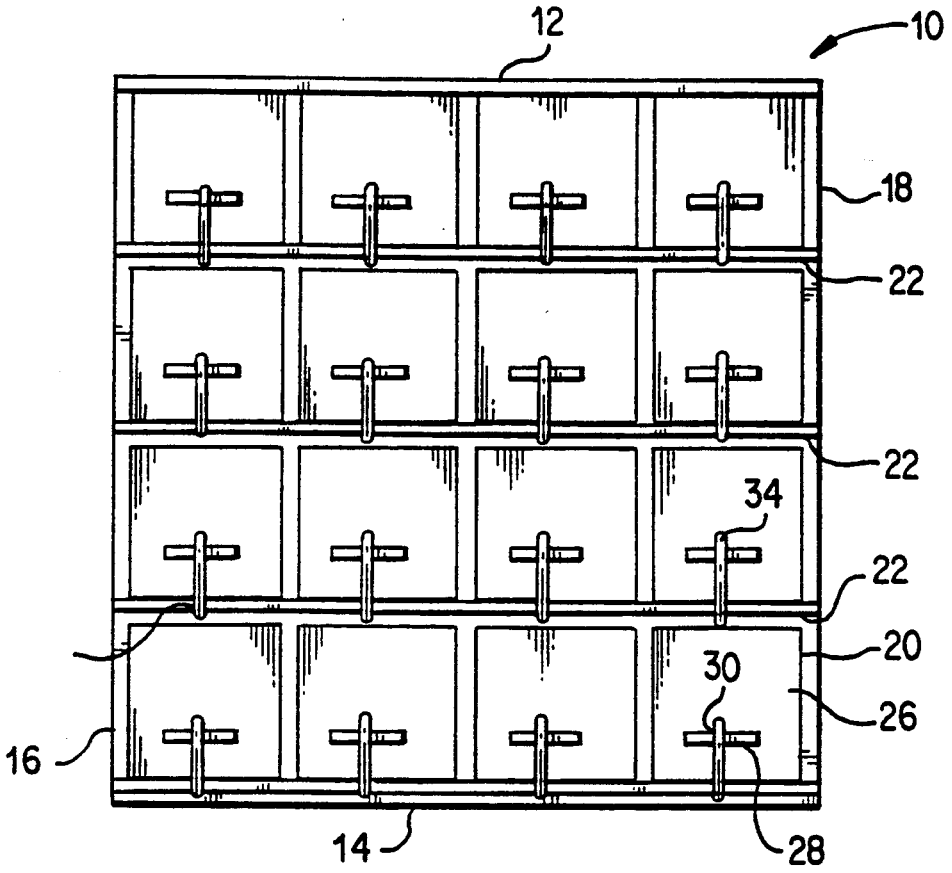
FIG. 1 is a front view of a cabinet in accordance with the present invention.

Referring now to the drawings, and particularly to FIG. 1 thereof, a storage cabinet 10 in accordance with the present invention is described.

Cabinet 10 comprises a top wall 12, a bottom wall 14 and two side walls 16 and 18. A plurality of drawers 20 are slidably provided in cabinet 10.

Shelves 22 are mounted to at least side walls 16 and 18 of cabinet 10. Shelves 22 form horizontal partitions between vertically positioned drawers 20.

Figure 4:
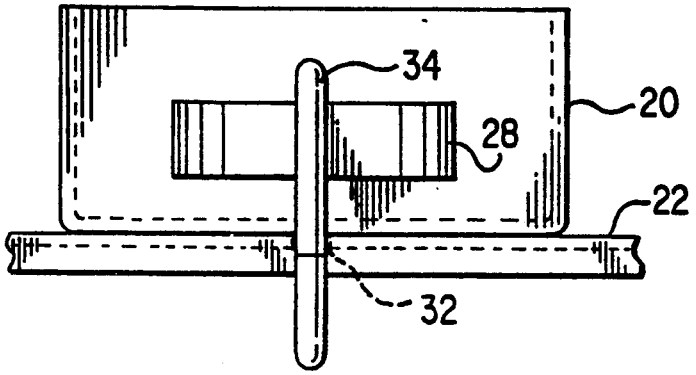
FIG. 4 is a front view of a drawer of the FIG. 1 cabinet.
Figure 2:
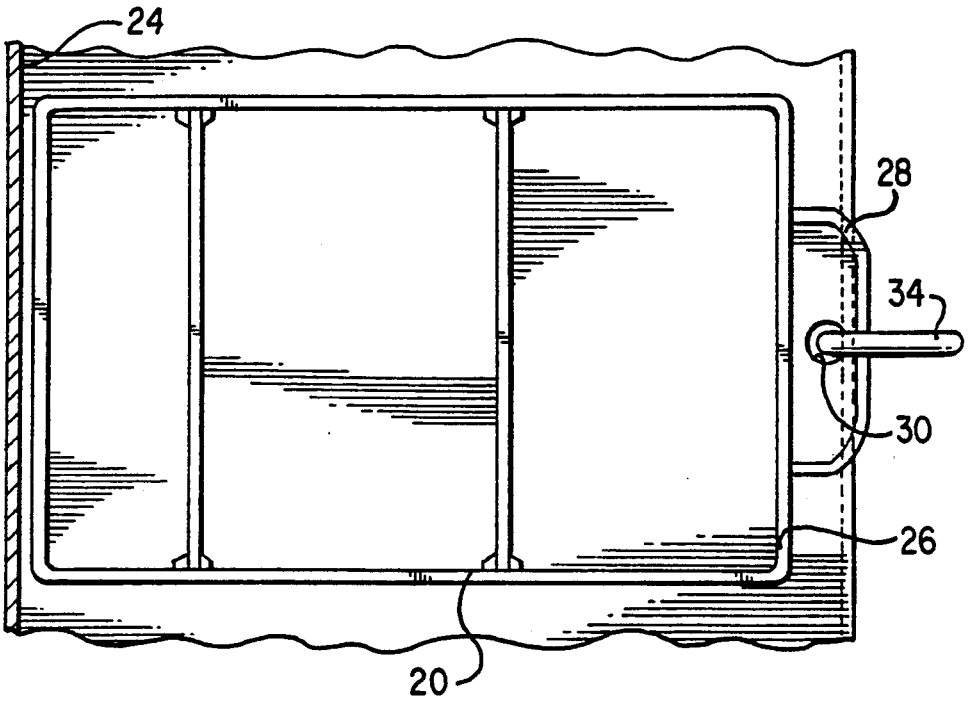
FIG. 2 is a top view of a drawer of the FIG. 1 cabinet.
Figure 3:
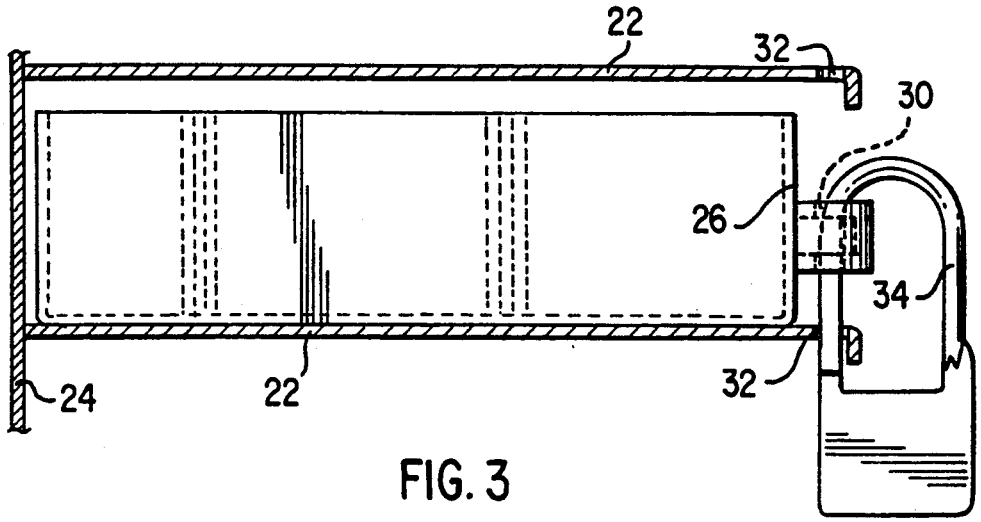
FIG. 3 is a side view of a drawer of the FIG. 1 cabinet.

As illustrated in FIGS. 2–4, drawers 20 of cabinet 10 abut a rear wall 24 of cabinet 10. Each drawer has a front face 26 which preferably includes a member 28 which extends therefrom. The front face 26 of each drawer is recessed approximately ½ inch from the front surface of shelf 22. Member 28 has a hole 30 which extends therethrough, hole 30 having an approximate 3/16 inch diameter. Hole 30 extends vertically and is located substantially at the center of front face 26 of drawer 20. Hole 30 is located approximately ⅜ inch inside a center line of a vertical front wall of each drawer face 26.

As illustrated in FIGS. 3 and 4, shelf 22 has holes 32 located therein. Holes 32 are vertically aligned with holes 30. The holes 32 in shelves 22 can be located either above or below a respective drawer 20. Shelf holes 32 are approximately 3/16 inch in diameter, holes 32 being centered horizontally above each front face 26 of drawer 20. The center lines of holes 32 are located a given distance, e.g. ¼ inch, from the front of shelves 22 so as to permit vertical alignment with drawer holes 30.

For any drawer 20 which is desired to be locked, a break lock pull-tight security seal is inserted through a drawer hole 30 and a shelf hole 32 which is vertically aligned with the drawer hole 30. The seal is pulled tightly in order to lock the drawer. Accordingly, in order to obtain access to items contained within the locked drawer 20, the break lock pull-tight security seal must be twisted and broken. Thus, a broken seal provides a ready indication that its respective drawer 20 has either been opened or tampered with.

An individual wishing to take inventory of used items, restock used items, etc. need only identify broken seals to determine which of drawers 20 must be checked for supplies, thus eliminating the time-consuming task of opening each drawer to check if the contents therein have been used and need to be replaced.

The present invention thus secures inventory items in individually sealed drawers of a multiple drawer utility cabinet until such time as the inventory items are needed, thus eliminating the necessity to re-inventory the contents of each drawer on a recurring basis. Only drawers with broken pull-tight security seals need to be checked. The locking system can be used in any industry where individual items need to be tightly controlled and restocked. Such industries include:

1. Storage of pharmaceuticals or other supplies in a hospital emergency room, nursing unit or ambulance where accountability and fast accessibility are important;

2. Storage of supplies or parts in manufacturing or other industries (e.g., telephone, utility, automotive and electronic supplies); and 3. Storage of components in service or delivery vehicles.

While this invention has been described in conjunction with a specific embodiment thereof, it is evident that many alternatives, modifications and variations will be apparent to those skilled in the art. Accordingly, the preferred embodiment of the invention as set forth herein is intended to be illustrative, not limiting. Various changes may be made without departing from the spirit and scope of the invention as defined in the following claims.

I claim:

1. A storage unit, comprising:

a cabinet having top, bottom and side walls;

a plurality of drawers provided in said cabinet, at least two of said drawers being vertically aligned; and an individual seal provided on at least one of said drawers, said seal providing an easily visible indication that the at least one drawer on which said seal is provided has been one of opened and tampered with, wherein said cabinet includes at least one horizontal shelf provided between said top and bottom walls, said at least one shelf having ends supported by said side walls, said at least one shelf forming a partition between said vertically aligned drawers, said at least one shelf including at least one shelf hole and each said drawer which is to be locked includes a drawer hole, said at least one shelf hole and said drawer holes being positioned such that at least one said shelf hole and one said drawer hole are aligned, said seal being threaded through said aligned holes.

2. The storage unit according to claim 1, said at least one shelf hole and said drawer holes are centered along a front face of each of said drawers which are to be locked.

3. The storage unit according to claim 1, wherein said seal is a break lock pull-tight seal.

* * * * *